United States Patent [19]

Trowbridge

[11] 4,422,132

[45] Dec. 20, 1983

[54] FLUORESCENT-TYPE FIXTURE HAVING IMPROVED FOLD-OUT LAMP SOCKET ASSEMBLIES

[75] Inventor: Charles A. Trowbridge, Wrightstown, Pa.

[73] Assignee: Sim Kar Lighting Fixture Co., Inc., Philadelphia, Pa.

[21] Appl. No.: 330,390

[22] Filed: Dec. 14, 1981

[51] Int. Cl.[3] ..... F21V 19/02

[52] U.S. Cl. ..... 362/220; 362/147; 362/362; 362/404; 362/429

[58] Field of Search ..... 362/147, 217, 220, 362, 362/404, 429

[56] References Cited

U.S. PATENT DOCUMENTS

| | | | |
|---|---|---|---|
| 3,770,952 | 11/1973 | Trowbridge | 240/51.11 |
| 4,109,303 | 8/1978 | Hetherington | 362/216 |
| 4,280,169 | 7/1981 | Allen | 362/217 |
| 4,298,918 | 11/1981 | Metcalf | 362/217 |

*Primary Examiner*—Peter A. Nelson

*Attorney, Agent, or Firm*—Howson and Howson

[57] ABSTRACT

A fluorescent lamp fixture has a pair of lamp socket assemblies which are normally retracted for shipment but which are pivoted outwardly for installation. The fixture comprises a channel member having a web with a pair of upstanding sidewalls and a pair of socket assemblies pivotally-mounted between the sidewalls. The sidewalls have aligned shaped apertures each with an entrance slot, and the base member has a pair of ear assemblies shaped to slide downwardly through the slots and into the apertures during assembly and to lock the socket assembly to the channel member when the socket assembly is pivoted through a predetermined angle. Cooperating latch assemblies are provided on the channel member and socket assembly for locking the socket assembly in its extended position. Closure plates are provided for the ends and top of the channel.

9 Claims, 8 Drawing Figures

FLUORESCENT-TYPE FIXTURE HAVING IMPROVED FOLD-OUT LAMP SOCKET ASSEMBLIES

FIELD OF THE INVENTION

The present invention relates to lighting fixtures, and more particularly, the present invention relates to fluorescent-type lighting fixtures having fold-out socket assemblies.

BACKGROUND OF THE INVENTION

In U.S. Pat. No. 3,770,952 issued to the assignee of the present application, there is disclosed a fluorescent-type lighting fixture having lamp engaging sockets which are stowed within the fixture for shipment but which are pivoted outwardly into an erect usage position for installation. The fixture comprises a channel member having a web with a pair of upstanding sidewalls each having a shaped aperture adapted to receive curved outstruck portions of the metal base of the socket assembly. The pivot connections are located relatively close to the bottom of the channel. A latch assembly is provided to lock the socket assembly in its erect usage configuration, and cooperating appendages are provided on the socket assembly and a closure plate for securing the closure plate across one end of the channel after the socket assembly has been erected. A snap-on closure plate is also provided for the top of the channel.

While the above-described lighting fixture has been commercially successful, there is a need for further improvement. For instance, some people have difficulty in rapidly aligning the pivot connections during assembly of the fixture. Accordingly, there is a need for structural improvements which would simplify assembly procedures while providing a strong fixture.

OBJECTS OF THE INVENTION

With the foregoing in mind, a primary object of the present invention is to provide a lighting fixture having improved fold-out socket assemblies which overcome the limitations of the prior art.

Another object of the present invention is to provide a novel lighting fixture which has fold-out lamp sockets which are capable of being assembled readily and hence manufactured economically.

A still further object of the present invention is to provide a unique lighting fixture having fold-out socket assemblies which cooperate to strengthen the fixture when pivoted outwardly into their usage positions.

SUMMARY OF THE INVENTION

The present invention provides an improved mechanism for pivotally connecting fold-out lamp socket assemblies to a channel member which receives the lamp socket assemblies. The channel member has a web with a pair of upstanding sidewalls having shaped aligned apertures each of which opens to one edge of the sidewall via a slot. Each socket assembly has a lamp-engaging member which projects outwardly from a base member received between the sidewalls of the channel member. A pair of ears are outstruck from opposite sides of the base member and are sized in relation to the slot and aperture to enable the socket assembly to be assembled with the channel member simply by pushing the socket assembly into the channel. The socket assembly is erected at the installation site when it is pivoted through a predetermined angle. A latch assembly is provided in the sidewalls of the channel member and the socket assembly for locking the socket assembly in its erect usage position. When in such position, the socket assembly also cooperates to hold a closure plate in position across one end of the channel member. An elongated closure plate mounts to the channel member to complete the assembly.

BRIEF DESCRIPTION OF THE DRAWINGS

The foregoing and other objects, features and advantages of the present invention should become apparent from the following description when taken in conjunction with the accompanying drawings, in which.

DESCRIPTION OF PREFERRED EMBODIMENT

Figure 1:
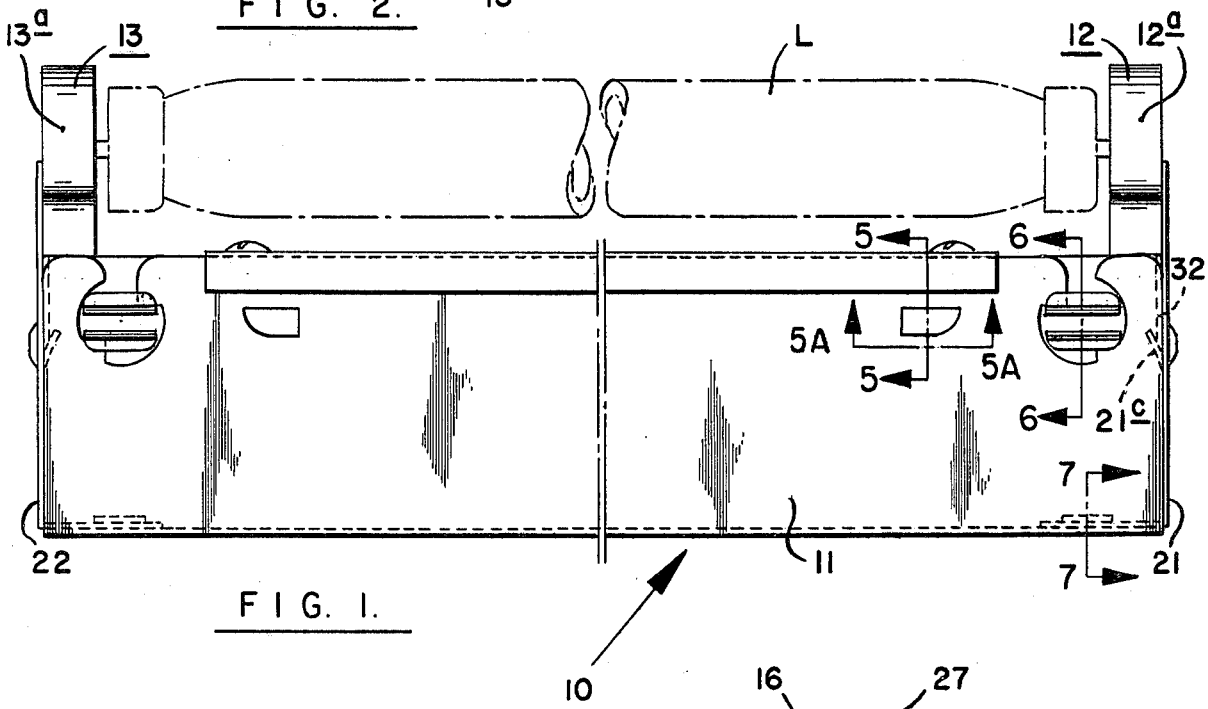
FIG. 1 is a longitudinally-foreshortened side elevational view of a lighting fixture which embodies the present invention.

Referring now to the drawings, FIG. 1 illustrates a lighting fixture 10 which embodies the present invention. As best seen therein, the lighting fixture 10 comprises an elongated channel member 11 which mounts at opposite ends a pair of socket assemblies 12 and 13. An elongated cylindrical fluorescent lamp L is shown in dot-dash lines mounted between the socket assemblies 12 and 13 in the customary manner.

Figure 2:
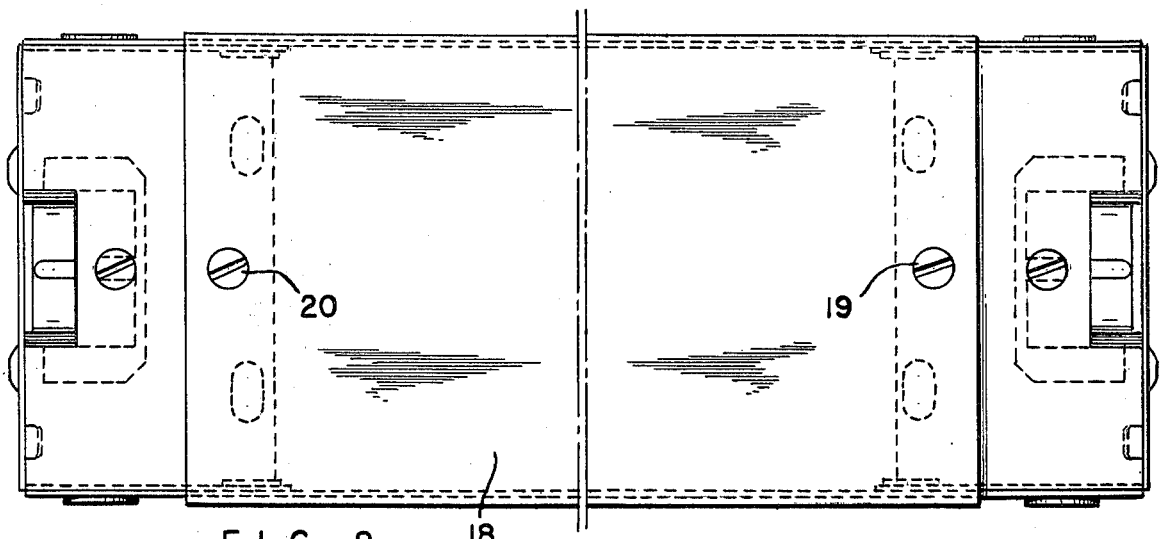
FIG. 2 is a plan view of the fixture illustrated in FIG. 1 but without the lamp shown in dot-dash lines.
Figure 3:
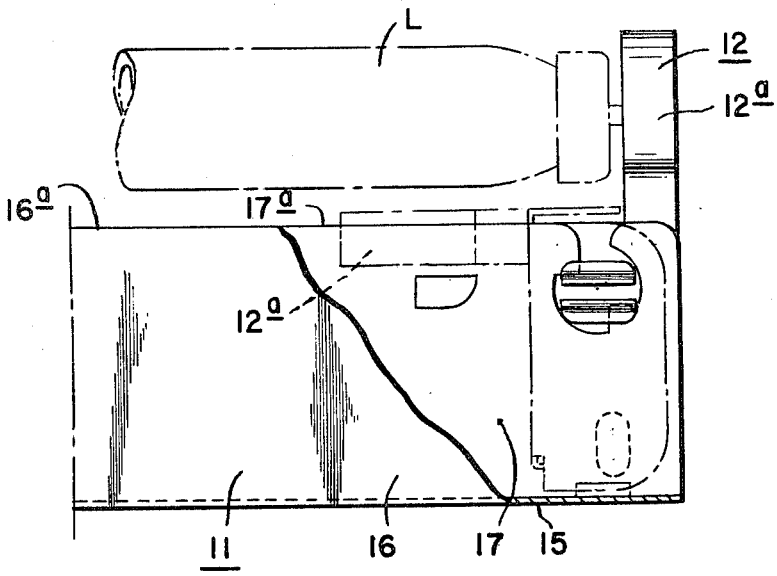
FIG. 3 is a fragmentary sectional view showing the right-hand end of the fixture in FIG. 1 but illustrating the socket assembly in its folded shipping configuration in dot-dash lines and in its erect usage configuration in full lines.
Figure 7:
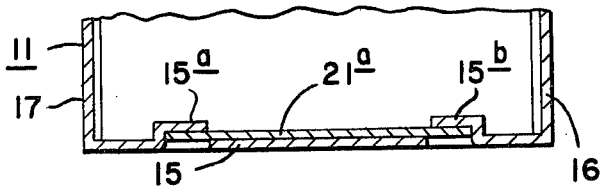
FIG. 7 is an enlarged fragmentary sectional view taken on line 7—7 of FIG. 1.

As best seen in FIGS. 3 and 7, the channel member 11 is a one-piece metal construction having a web 15 and a pair of sidewalls 16 and 17 projecting upwardly from the web 15 to form a generally U-shaped open channel. A channel closure plate 18 (FIG. 2) mounts across the upper edges 16*a* and 17*a* of the sidewalls 16 and 17, respectively to close the top of the channel member 11. The closure plate 18 may be fastened to the socket assemblies 12 and 13 by conventional means, such as screws 19 and 20. Closure plates 21 and 22 are mounted at opposite ends of the channel member 11 in a manner to be described.

The lighting fixture 10 is illustrated in FIG. 1 in its assembled configuration. In such configuration, the lamp sockets 12 and 13 extend laterally outward from the channel member 11. Because the lamp-engaging portions 12*a* and 13*a* of the socket assemblies 12 and 13 are of hard plastic insulating material which is prone to breakage, the fixture 10 is designed in such a manner that each socket assembly, such as the socket assembly 12, is capable of being shipped with the lamp-engaging member 12*a* thereof substantially completely received within the channel member 11, such as in the manner illustrated in dot-dash lines in FIG. 3. Thus, the lamp-engaging member 12*a* is protected during shipment so that breakage is kept to a minimum.

The socket assemblies 12 and 13 can be erected quickly at the installation site. For this purpose, the socket assemblies 12 and 13 are mounted to pivot relative to the channel member 11 from the inwardly-folded shipping position to the outwardly-folded usage position. While a lighting fixture having pivotally-mounted socket assemblies is disclosed in U. S. Pat. No. 3,770,952, and while the patented fixture functions satisfactorily, it is not as simple to assemble on a mass-production basis as desired.

In accordance with the present invention, certain improvements have been made in the construction of the socket assemblies and the channel member to overcome the aforementioned assembly difficulties. To this end, the channel member and socket assemblies are designed so that they can be assembled simply by pushing the socket assembly into the channel with its lamp-engaging portion extending parallel to the channel in its shipping position. The socket assembly and channel are designed also to interlock and latch positively when the lamp-engaging member is pivoted through a predetermined angle of about 90° into the full line position illustrated in FIG. 3.

Figure 4:
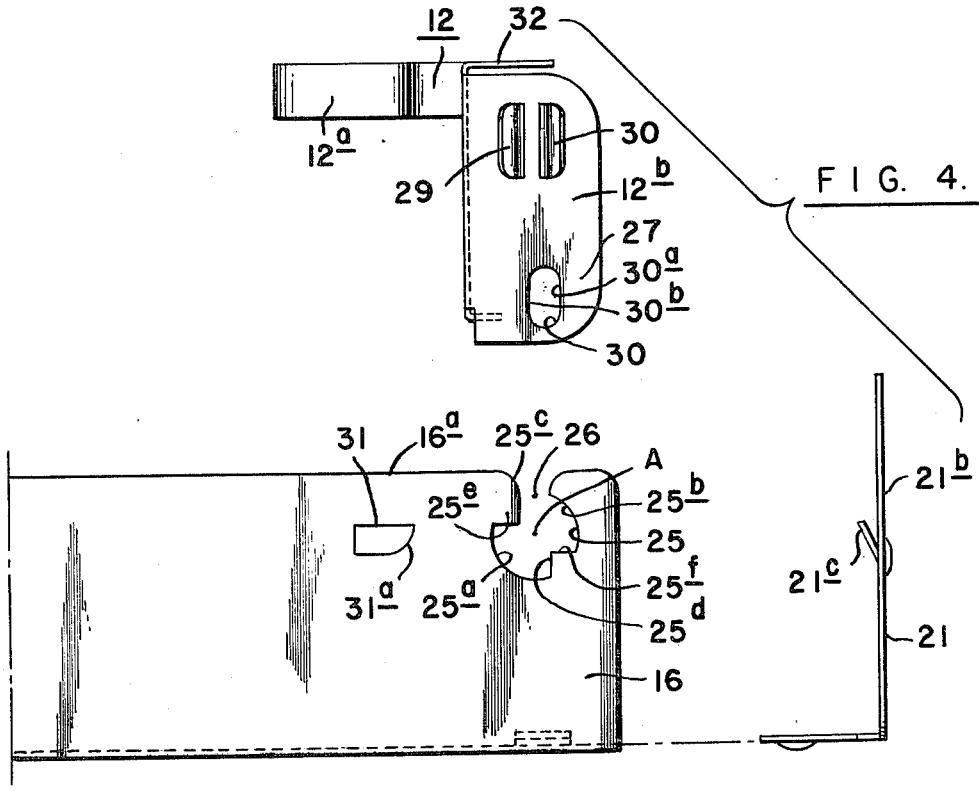
FIG. 4 is an exploded view illustrating the channel member, socket assembly and end closure plate prior to assembly.

The improved construction by which the aforementioned advantages are realized may be best seen by reference to FIG. 4. As seen therein, each sidewall of the channel member 11, such as the front sidewall 16, is provided with a shaped aperture 25. The apertures in each sidewall are aligned horizontally with one another to provide a horizontal pivot axis A for the socket assembly 12. The shaped apertures, such as the aperture 25, are located closer to the upper edge 16*a* of the sidewall 16 than to the web 15 of the channel member 11. A slot 26 is provided in each sidewall, such as the sidewall 16, and provides a lateral opening into the aperture 25 from the upper edge 16*a* of the sidewall 16 for purposes to be described. The aperture 25 is defined by a pair of diametrically-opposed arcuate sections 25*a* and 25*b* which are separated by a pair of horizontally-offset vertical surfaces 25*c* and 25*d* which intersect a pair of vertically-offset horizontal surfaces 25*e* and 25*f* to provide a pair of inwardly-directed teeth. The surfaces 25*c* and 25*d*, and the surfaces 25*e* and 25*f* are located on opposite sides of the pivot axis A in the manner illustrated in FIG. 4. The opposite sidewall 17 has a similarly-shaped aperture (not shown) with surfaces similarly located.

The socket assembly 12 includes the plastic lamp-engaging member 12*a* and a base member 12*b* which is pivotally-mounted to the channel member 11. The lamp-engaging member 12*a* and the base member 12*b* cooperate to form a generally L-shaped assembly. The base member 12*b* is fabricated of metal and has a pair of downturned side flanges, such as the side flange 27 illustrated in FIG. 4. The side flanges of the base member 12*b* are dimensioned so as to be received closely alongside the inside surfaces of the channel member sidewalls 16 and 17 when the socket assembly 12 is inserted into the channel member 11.

Figure 6:
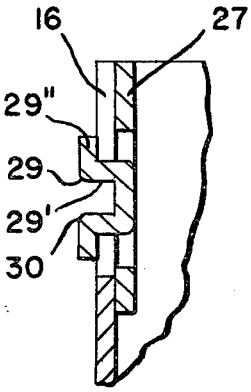
FIG. 6 is an enlarged fragmentary sectional view taken on line 6—6 of FIG. 1.

For the purpose of providing the pivot connection between the socket assembly 12 and the channel member 11, a pair of ears 29 and 30 are outstruck from the side flanges 27 of the socket assembly base member 12*b*. The ears 29 and 30 are disposed relatively close to one another at the point where their webs protrude from the plane of the base member side flange 27. The dimension is such as to permit the ears 29 and 30 to slide downwardly in the slot 26 when the base member 12*b* is pushed into the channel member 11. As best seen in FIG. 6, each ear, such as the ear 29 has a web 29' integral with the base member side flange 27 and an outer flange 29'' adapted to engage the outside of the channel member sidewall 16 adjacent the shaped aperture after the socket assembly 12 has been rotated through an included angle of about 90°. Thus, the channel member sidewall 16 is captured between the flange 29'' of the ear 29 and the flange 27 of the socket assembly base member, thereby preventing the upper edges 16*a* and 17*a* of the channel member 11 from spreading apart when the socket assembly 12 is in its extended usage position. Moreover, the surfaces 25*e* and 25*f* cooperate to limit the amount of pivotal movement of the socket assembly 12 and thereby insure accurate positioning of the lamp-engaging member 12*a* relative to the channel member 11. Of course, the interengagement of the ears 29 and 30 with the surfaces of their shaped mounting apertures also prevents the socket assembly 12 from being disengaged from the channel member after it has been erected.

Figure 5:
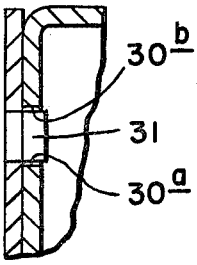
FIG. 5 is an enlarged fragmentary sectional view taken on line 5—5 of FIG. 1.
Figure 5A:
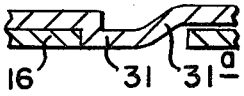
FIG. 5A is an enlarged fragmentary sectional view taken on line 5A—5A of FIG. 1.

The socket assemblies 12 and 13 are automatically locked in their usage positions. For this purpose, cooperating latch means is provided on each socket assembly, such as the socket assembly 12, and the channel member 11. As best seen in FIG. 4, the latch means comprises an oval aperture 30 provided in at least one, and preferably both, of the socket base member flanges 27. The aperture 30 is defined by a pair of surfaces 30*a* and 30*b* extending in spaced parallel relation. A shaped protrusion 31 is pressed inwardly of the channel from each of the sidewalls, such as the sidewall 16. The protrusion 31 has an outwardly and upwardly inclined camming surface 31*a* (FIG. 5A) spaced from the pivot axis A about the same distance as the aperture 30 is spaced. The ramp portion 31*a* is adapted to engage the flange 27 of the base member 12*b* and to spread the upstanding sidewalls 16 and 17 apart slightly as the socket assembly 12 is pivoted upwardly. As soon as the upper edge 30*a* of the aperture passes above the protrusion 31, the sidewalls 16 and 17 snap together and cause the protrusion 31 to engage in the aperture 30 in the manner illustrated in FIG. 5 to latch the socket assembly 12 in its extended position illustrated in FIG. 1.

At the same time, the ears 29 and 30 cooperate to pull together the sidewalls 16 and 17 of the channel member 11 adjacent their upper edges and thereby cooperate to insure that the protrusion 31 is maintained in the aperture 30 and that the socket assembly 12 is properly latched in its extended position.

The end closure plate 21 is automatically held in place by the socket assembly 12. For this purpose, and as best seen in FIG. 4, the end closure plate 21 has an inturned tongue 21*a* which slides between a pair of upstruck flanges 15*a* and 15*b* of the channel member web 15. See FIG. 7. The closure plate 21 also has at least one, and preferably a pair, of instruck tabs 21*c* which engage a downturned flange 32 extending along the rear of the base member 12*b* of the socket assembly 12. See FIG. 1. Thus, the closure plate 21 is assembled with the channel member 11 by sliding its tongue 21*a* between the flanges 15*a* and 15*b* prior to rotating the socket assembly 12 in the manner previously discussed. As the socket assembly 12 is pivoted into its usage position, the downturned flange 32 engages the tab 21*c* and, when the socket assembly 12 is latched, it prevents the closure plate 21 from being disengaged from the channel member 11. The top closure plate 18 is screwed to the socket assemblies 12 and 13 after they have been pivoted into their usage positions.

From the foregoing, it should be apparent that the lighting fixture of the present invention is relatively easy to assemble. This is because one need simply to align the socket assembly ears 29 and 30 with the slots 26 before pushing the socket assembly 12 downwardly into the channel 11 until it bottoms out on the bottom web 15. The socket assembly 12 remains in that position for shipment with its lamp-engaging member 12*a* protected from damage. At the installation site, the closure plate 21 is slid into the end of the channel 11, and the socket assembly 12 is pivoted outwardly until it latches. The socket assembly 12 is thereby placed in the proper position for accepting the lamp L. At the same time, the sidewalls of the channel member are restrained against spreading apart while a positive latching action is created.

In view of the foregoing, it should be apparent that the present invention now provides a lighting fixture having fold-out lamp sockets which are not only easy to assemble but which also cooperate to strengthen the assembled fixture.

While a preferred embodiment of the present invention has been described in detail, various modifications, alterations and changes may be made without departing from the spirit and scope of the present invention as defined in the appended claims.

I claim:

1. In a lighting fixture having a channel member with a web and a pair of upstanding sidewalls terminating in edges and at least one fold-out socket assembly carried by said channel member, and means mounting said socket assembly to pivot from a folded-in shipping position to a folded-out usage position, the improvement wherein said mounting means includes:

a shaped aperture located in each of said sidewalls and aligned with one another to provide a pivot axis for said socket assembly, means in each sidewall providing a slot connecting said shaped aperture with an edge of the sidewall, and a pair of ears struck outwardly from the socket assembly, said aperture and slot being sized relative to said ears to enable said socket assembly to be displaced into said channel when said ears are aligned with said slot and being sized to prevent disengagement of said socket assembly from said channel after said socket assembly has been pivoted into its folded out usage configuration, and latch means on said sidewalls and socket assembly cooperating to lock said socket assembly when said socket assembly is pivoted into said folded-out usage position.

2. A lighting fixture according to claim 1 wherein said aperture has a pair of vertically-offset horizontal surfaces and a pair of horizontally-offset vertical surfaces disposed on opposite sides of said pivot axis, and said ears have lengthwise and widthwise dimensions, said widthwise dimension being smaller than said slot to afford passage between said horizontally-offset vertical surfaces, and said ears having a lengthwise dimension for engaging said vertically-offset horizontal surfaces when said ears are received in said apertures and said socket assembly is rotated through a predetermined included angle to extend said socket assembly.

3. A lighting fixture according to claim 2 wherein said ears have outturned flanges engaging the outsides of said channel member sidewalls adjacent the periphery of said aperture when rotated through said angle, whereby the ear flanges cooperate to prevent the channel sidewalls from spreading when said socket assembly is folded-out.

4. A lighting fixture according to claim 3 wherein said sidewall edges extend lengthwise of the channel member, said apertures are located closer to said edges than to said channel web, and said slots extend inwardly to the apertures from said lengthwise extending edges of the sidewalls.

5. A lighting fixture according to claim 3 wherein said socket assembly has a base member and a socket member disposed orthogonal to one another, and said lengthwise dimension of said ears is disposed orthogonal to said socket member, whereby the socket member is automatically aligned with the channel member upon insertion of the socket assembly into the channel.

6. A lighting fixture according to claim 1 wherein said latching means includes a protrusion extending inwardly from at least one of said sidewalls of said channel member, and means defining a pair of edges located in said socket assembly and spaced from said pivot axis for receiving said protrusion after said socket assembly has been pivoted through a predetermined included angle.

7. A lighting fixture according to claim 6 wherein said protrusion has a ramp portion adapted to engage said socket assembly as it pivots about its pivot axis, said ramp portion and socket assembly cooperating resiliently to deflect said channel member sidewalls outwardly to enable said protrusion to engage between said edges when said socket assembly is folded-out and thereby to latch said socket assembly in its usage position.

8. A lighting fixture according to claim 1 wherein said socket assembly has a downturned flange extending between the sidewalls of said channel member, and including a closure plate adapted to be mounted across an end of said channel member, said closure plate having at least one tab adapted to interengage said socket assembly flange when said socket assembly is latched in its folded-out configuration to retain said closure plate across said end of the channel member.

9. A lighting fixture according to claim 8 wherein said channel member web has a pair of upstruck retainers and said closure plate has a tongue adapted to slide along said web and between said upstruck retainers.

* * * * *